US005473929A

United States Patent [19]

Karash

[11] Patent Number: 5,473,929

[45] Date of Patent: Dec. 12, 1995

[54] OFFSET TOOL

[75] Inventor: L. Stanley Karash, Hastings, Nebr.

[73] Assignee: Karding, Inc., Hastings, Nebr.

[21] Appl. No.: 164,192

[22] Filed: Dec. 8, 1993

[51] Int. Cl.[6] ..... B21J 13/08

[52] U.S. Cl. ..... 72/458; 72/479; 72/199; 254/129; 492/13

[58] Field of Search ..... 81/177.85, 20, 81/25, 177.2; 254/18, 21, 113, 116, 119, 120, 129, 131.5; 7/166; 492/13, 19, 60; 72/458, 479, 199

[56] References Cited

U.S. PATENT DOCUMENTS

| | | | |
|---|---|---|---|
| 1,316,451 | 9/1919 | Kennedy . | |
| 1,492,900 | 7/1922 | Scott . | |
| 2,379,387 | 6/1945 | Tessier . | |
| 2,524,321 | 10/1950 | Le masters | 72/458 |
| 2,649,824 | 8/1953 | Maxwell | 81/177.85 X |
| 2,669,147 | 2/1954 | Koenig | 81/177.1 X |
| 2,804,109 | 8/1957 | Fatica . | |
| 2,825,254 | 3/1958 | Peltcher | 81/177.85 X |
| 3,039,339 | 6/1962 | Hanson | 81/DIG. 8 X |
| 3,680,838 | 8/1972 | Dunn | 254/131 |
| 3,988,918 | 11/1976 | Crees | 72/458 |
| 4,089,077 | 5/1978 | Morton | 7/166 X |
| 4,485,702 | 12/1984 | Swan et al. | 81/177.2 X |
| 4,625,945 | 12/1986 | Hearn et al. | 254/25 |

*Primary Examiner*—D. S. Meislin
*Attorney, Agent, or Firm*—Head & Johnson

[57] ABSTRACT

A tool with socket means for connecting the tool to an ordinary ratchet wrench or the like. The tool includes an offset head portion having socket means, the head portion located in the rearward end for attaching the tool to a ratchet wrench or the like. The forward body portion can be a wedge-shaped, two-prong fork means that is used for spreading, prying, pulling and lifting or it can be an elongated telescoping rollerhead that is used to straighten a piece of metal or essentially any other forward body portion. The offset head portion with socket means not only allows attachment to any ordinary ratchet wrench or the like but it also allows the operator to use the tool when attached to the rachet in extremely confining places whereas a tool not disclosed by the invention could not effectively work.

1 Claim, 3 Drawing Sheets

14
16
B
17
18
A
10
12
20

30
32
12

OFFSET TOOL

BACKGROUND OF THE INVENTION

The present invention is directed to a tool having an offset head portion and a socket means that enables attachment to a ratchet wrench or the like. The offset head portion when attached to the ratchet wrench or the like allows the operator to use the ratchet wrench or the like with the attached tool in places that would otherwise be too confining for similar conventional tools.

The presently known methods of spreading, prying, pulling and lifting metal pieces or nails or other fasteners from wood boards have usually comprised articles of manufacture such as pry bars, crow bars and the like, i.e. devices without moving parts. Such devices, however, are not efficient in areas where space is limited. One example of a prior art pry bar device is that shown in U.S. Pat. No. 4,625,945 dated Dec. 2, 1986 in the name of Hearn et al. and entitled "Pry Bar Wedge Member".

The prior art device of U.S. Pat. No. 4,625,945 mentioned above employs a ratchet means, which is a part of the tool itself. One problem with the aforesaid U.S. patent is that the prior art device requires a ratchet mechanism to each tool. Further, in using the prior art tool the ability to reverse the ratchet mechanism becomes awkward when used in confining areas, e.g., in vehicle body and frame work.

Other pry bar structures are illustrated in U.S. Pat. Nos. 1,070,571; 1,316,451; 1,492,900; 2,379,387; and 2,804,109.

SUMMARY OF THE INVENTION

An object of this invention is to provide an improved and less expensive method and tool for spreading, prying, pulling, lifting and straightening metal panels and the like. The present invention provides a novel offset tool that is attachable to a readily available ordinary and standard ratchet or socket wrench or the like. The offset head of the tool of this invention, once attached to the ratchet wrench or the like, enables the tool to work in very unlimited positions even in confining places. The socket means, which is located in the offset head portion of the tool of this invention, becomes an efficient, economical and multi-purpose attachment for use with any ordinary ratchet wrench or the like.

A further object of the invention is to provide a tool that enables an operator to purchase only one ratchet wrench or the like for use with multiple attachable tools such as those disclosed herein.

A yet further object of the invention is to provide a tool that is adaptable to any ordinary ratchet wrench or the like wherein the attachable tools can come in a variety of functional forward working body portions, such as the wedged-shape, two prong fork means or the telescoping rollerhead elongated forward body portion both disclosed in the invention. It is obvious that the forward body position is not limited only to the disclosed tools as any number of forward body positions would work with the offset head portion having socket means, which is disclosed by this invention.

Another object of this invention when used in conjunction with a ratchet wrench or the like is to provide an increased leverage advantage when attempting to use the tool for spreading, prying, pulling, lifting, and straightening metal panels or the like.

A further object of this invention is that an operator, in auto body and frame repair environment, can accurately position the tool of this invention on the inside space of the doors and fenders to assist in returning outer panels to their original position. The attachment with the rollerhead is best suited for this application.

A further object of this invention is that when using the tool of this invention as a lifting device, e.g., removing nails, the mechanical advantage increases as the tool is raised or lowered by the ratchet wrench or the like. Therefore, the operator does not need to position the tool further under the object being lifted.

DETAILED DESCRIPTION OF THE PREFERRED EMBODIMENT

Figures 1, 2:
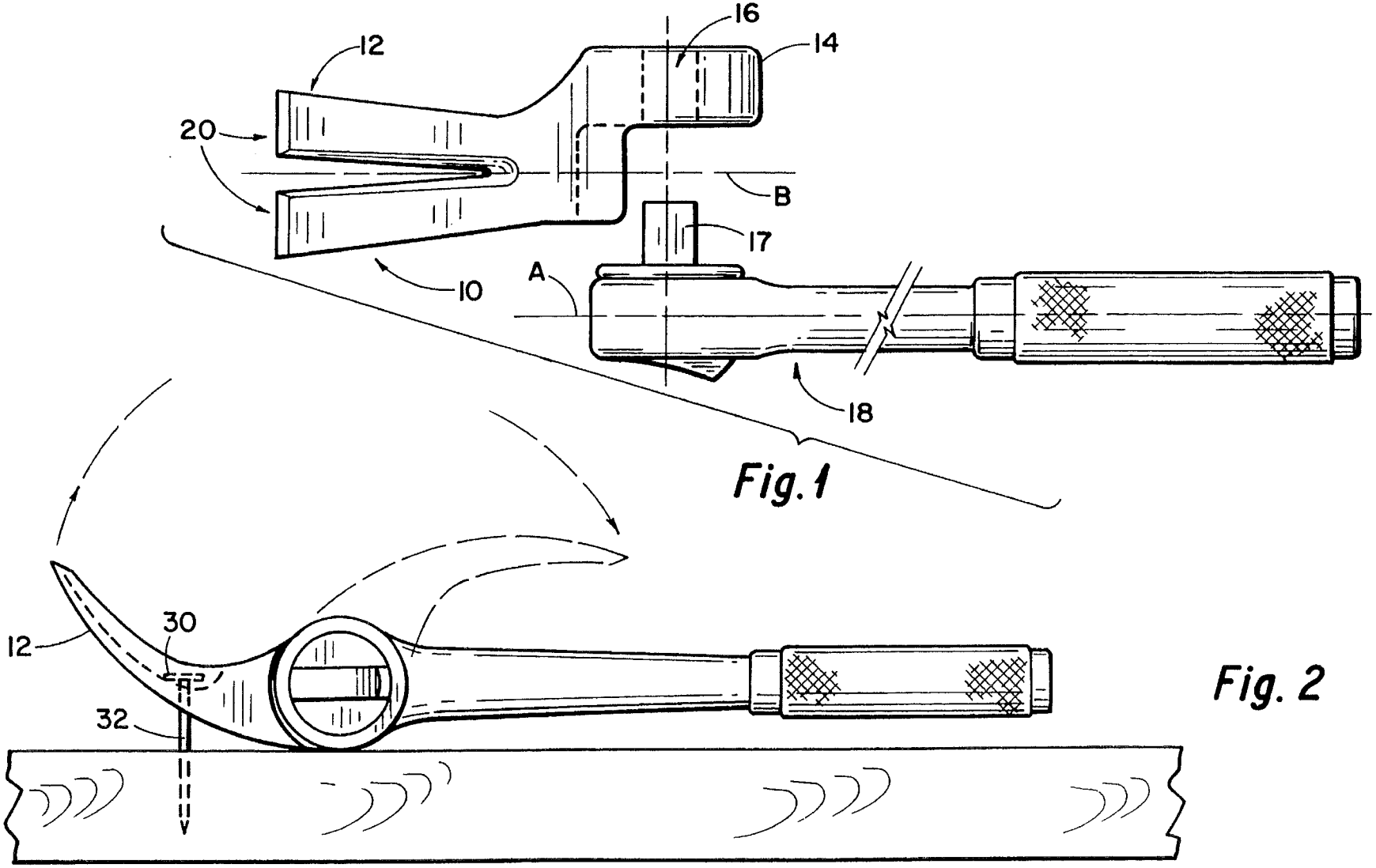
FIG. 1 depicts an exploded side view of an ordinary ratchet wrench with a wedge-shaped tool in accordance with the invention.
FIG. 2 depicts an action side elevation view of a wedge-shaped tool of this invention attached to a ratchet wrench.

FIG. 1 discloses one form of a tool generally designated by the numeral 10 for use in the invention. Tool 10 comprises a forward body portion 12 having, in this embodiment, a two-prong fork 20 that can be used to pry objects apart such as two bodies of metal such as when straightening certain body portions of a vehicle or to remove nails or other objects.

The forward body portion 12 can be made as one continuous piece of metal rather than that of a multiple-prong fork 20 as illustrated. The forward body portion 12 preferably has an upwardly sloping and rearwardly diverging top surface 14 which is offset from the forward body portion 12.

The offset portion 14 includes a female socket 16 adaptable for attachment to a standard male socket 17. The socket size may be small, e.g. ¼ inch, for less demanding jobs or larger, e.g. ½ up to 1 inch, for more demanding use.

One purpose of the offset in this instance is such that when the tool 10 is attached to ratchet socket wrench generally designated by the numeral 18 (FIG. 1) the longitudinal axis A of the wrench will be in line with the working-force axis B of the tool 10. However, in other instances the tool 10 could be reversed in which case the axis A and B will be offset.

The forward body portion 12 as shown in FIG. 2 may be used to facilitate receiving the head of a fastener 30, such as a nail 32, into the generally V-shaped groove of the two-prong fork 20 for facilitating removal of a headed fastener, for example, within an area that would otherwise be too confined to use a more common pry-bar.

Figure 3B:
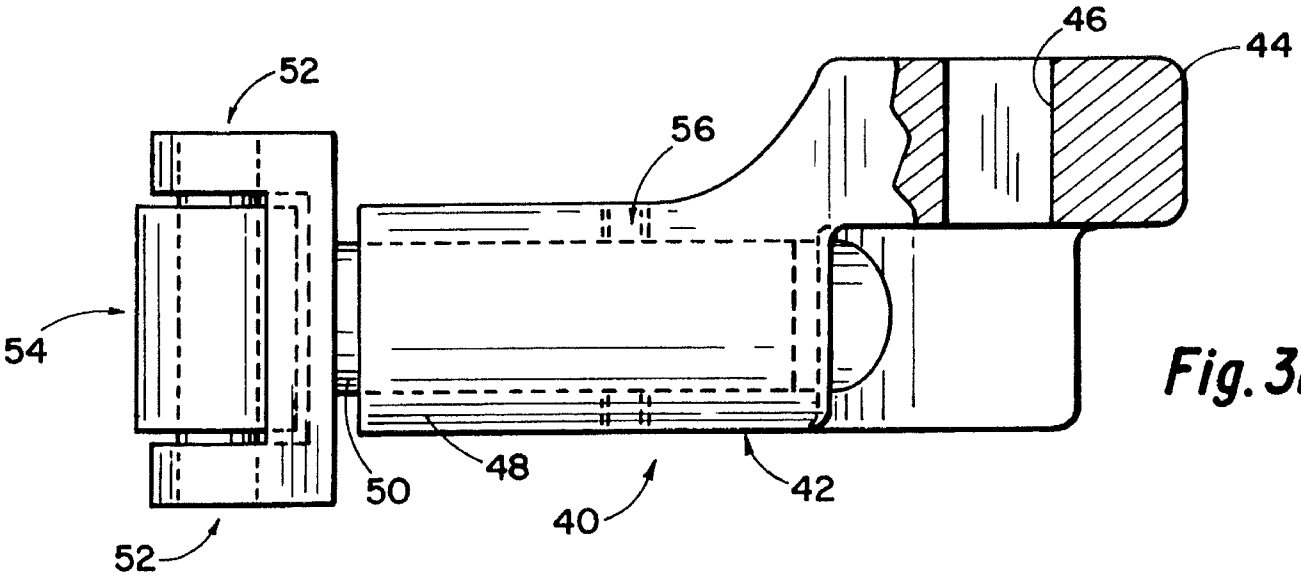
FIG. 3*b* depicts a top elevational view of the tool shown in FIG. 3*a*.
Figure 3A:
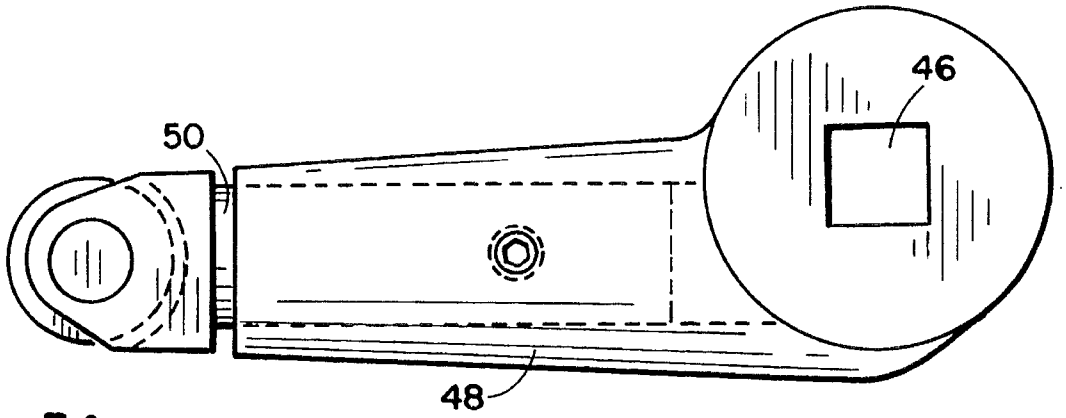
FIG. 3*a* depicts a side elevational view of a telescoping rollerhead tool disclosed by the invention.

FIGS. 3*a* and 3*b* disclose a tool 40 whose attachment to the ratchet wrench or the like is the same as previously described. The head portion 44 that connects to a ratchet wrench or the like is offset from the axis of the forward portion 44 of the tool 40 and has a socket means 46 that permits connection to the ratchet wrench or the like. The forward body portion 42 is comprised of a cylinder 48 that receives a piston 50, which is connected to a yoke 52 that houses a roller 54. The piston attachment is slidable within the cylinder walls and may be locked into various positions along the cylinder walls by, as for instance, threading a set screw 56 through the opening in the side of the cylinder until it contacts the piston 50. This allows the roller 54 to be extended or lengthened accordingly.

Figure 4B:
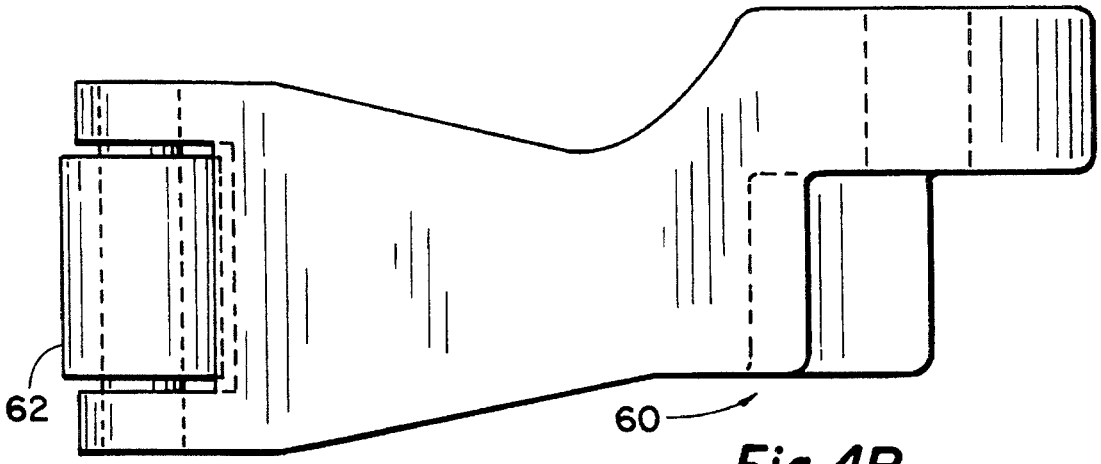
FIG. 4*b* depicts a top elevational view of the tool of FIG. 4*a*.
Figure 4A:
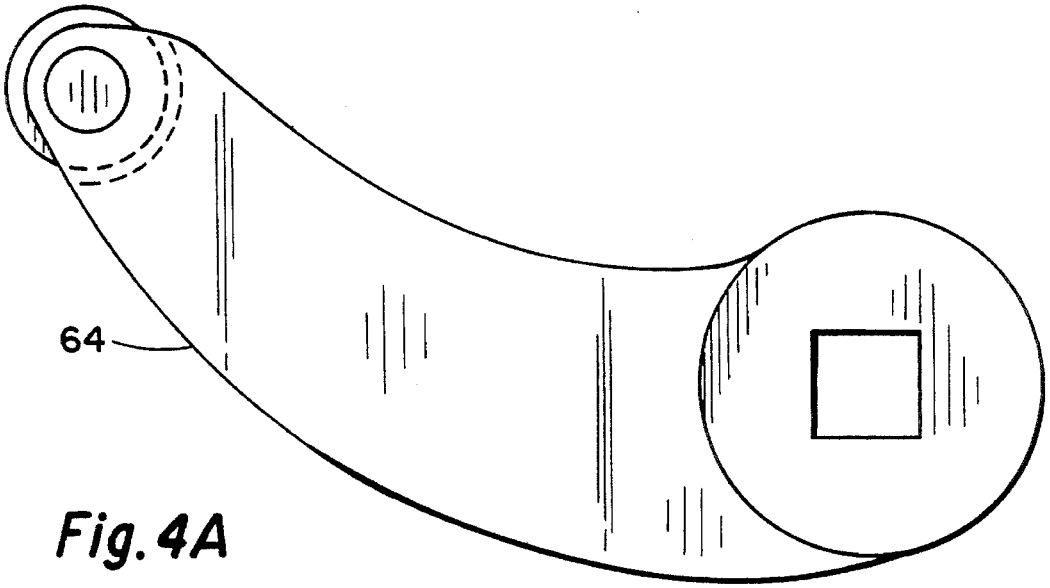
FIG. 4*a* depicts a side elevational view of a another form of rollerhead tool disclosed by the invention.

As seen in FIGS. 4*a* and 4*b*, another embodiment includes a tool generally designated by the numeral 60 similar to the type described in FIGS. 3*a* and 3*b* except that the embodiment in FIGS. 4*a* and 4*b* does not permit extending or lengthening of the roller 62. In addition, this embodiment discloses a forward body portion 64 that is curved, which allows use of the tool in positions and instances that would not be feasible for a straight tool as disclosed in FIGS. 3*a* an 3*b*.

The unique means of connecting the tool 10 to the ratchet wrench or the like because of the offset head portion enables the operator to maneuver and manipulate the tool in difficult to reach places and confining places as shown in FIG. 2.

The operation of either of the tools depicted in FIGS. 1–4 is essentially the same. As shown in FIG. 2, the tool can be used to extract a nail without having to lift the wrench handle more than 10°. Less that 10° travel up and down can effectively create 230° of travel at the working end of the tool. This is extremely beneficial where space does not permit the user to lift the wrench more than 10° from its resting position. This novelty is also particularly beneficial when using the tool be to spread or pry apart panels of metal such as in the auto body repair industry.

The tool shown in FIGS. 3 and 4 enables the operator to use same as a backup to straighten metal pieces such as vehicle bodies or the like while the operator taps or hammers on the opposite side of the metal piece while ratcheting the tool as needed.

The operation sets this disclosure apart from any other disclosed tool that may exist as prior art. The tool is adaptable and usable with any ordinary ratchet wrench or the like of varying drives. Therefore, an operator need only purchase or possess one ratchet wrench or the like for use with multiple tools such as the type disclosed by this invention. This is economical and efficient.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

I claim:

1. A tool for connection to a ratchet wrench for spreading, prying, pulling and lifting, comprising:

a forward working body portion comprised of a telescoping tool, said telescoping tool comprising a yoke attached to a piston that is slideably retained within a cylinder formed within said forward working body portion, said yoke supporting a rotatable roller; and a rearward portion connected to said forward working body portion and having socket means located in said rearward portion for attaching the tool to said ratchet wrench, said head portion being offset from the forward body portion.

* * * * *